United States Patent [19]

Takahashi et al.

[11] Patent Number: 4,576,371

[45] Date of Patent: Mar. 18, 1986

[54] SORTER HAVING GUIDE MEMBERS

[75] Inventors: Koji Takahashi; Akira Mochizuki, both of Kanagawa, Japan

[73] Assignee: Fuji Xerox Co., Ltd., Tokyo, Japan

[21] Appl. No.: 497,974

[22] Filed: May 25, 1983

[30] Foreign Application Priority Data

May 31, 1982 [JP] Japan ..... 57-92413

[51] Int. Cl.[4] ..... B65H 39/10

[52] U.S. Cl. ..... 271/296; 271/188

[58] Field of Search ..... 271/296, 297, 287, 305, 271/208, 209, 188, 278, 306; 162/270, 271

[56] References Cited

U.S. PATENT DOCUMENTS

| | | | |
|---|---|---|---|
| 3,372,922 | 3/1968 | Snellman et al. | 271/296 |
| 3,957,264 | 5/1976 | Bach et al. | 271/296 |
| 4,216,955 | 8/1980 | Avritt et al. | 271/296 |
| 4,235,435 | 11/1980 | Lawrence | 271/297 |

FOREIGN PATENT DOCUMENTS

| | | | |
|---|---|---|---|
| 0155151 | 12/1981 | Japan | 271/287 |

*Primary Examiner*—Bruce H. Stoner, Jr.
*Assistant Examiner*—John A. Carroll
*Attorney, Agent, or Firm*—Sughrue, Mion, Zinn, Macpeak & Seas

[57] ABSTRACT

A sorter for sorting copy sheets made from an original by a copying machine includes a plurality of trays which are vertically aligned in multiple stages at predetermined intervals, an indexer for delivering the copy sheets to the trays, a conveyor for conveying the copy sheets to the indexer, and a flexible guide member which is provided at the inlet portion of each of the trays for guiding each copy sheet from the indexer into one of the trays along the bottom surface of an adjacent upper tray.

7 Claims, 6 Drawing Figures

SORTER HAVING GUIDE MEMBERS

BACKGROUND OF THE INVENTION

1. Field of the Invention

The present invention relates to a method of sorting copy sheets and a sorter (automatic page arrangement device) which is capable of automatically classifying and arranging copied sheets when a plurality of sheets are copied from an original document, and, particularly, to a sorter for use in a copying machine which is intended to increase the number of copy sheets which can be accommodated in trays that are vertically arranged in multiple stages at predetermined intervals.

2. Description of the Prior Art

FIGS. 1A and 1B illustrate a conventional sorter which is used in a copying machine for automatically classifying and arranging a plurality of copy sheets. The copying machine-sorter arrangement of FIGS. 1A and 1B comprises a document feeding device 1 for automatically feeding an original document; a platen 2 for receiving the original document which is fed from the document feeding device in a predetermined position; an optical system 3 for projecting a picture image of the document which has been placed on the platen 2 onto an exposing station B; a photo-sensitive drum 4 which is capable of turning along its circumference past a charging station A, the above-mentioned exposing station B, a developing station C, a transferring station D and a cleaning station E (including an electrical discharger); a copy paper feeder 5; a fixing station F for fixing the picture image which has been transferred onto a sheet of copy paper; a discharge belt 6 for discharging a copied sheet into a sorter 20 with the help of discharge rollers 7; an actuating panel 8 for issuing commands for various operations; and the sorter 20 which is provided at the side of a copying machine 10. The sorter 20 comprises a first endless belt 21 for conveying a copy sheet which has been discharged through the discharge rollers 7; a second endless belt 23 for conveying a copy sheet to an indexer 22 in cooperation with the first endless belt 21; and the above-mentioned indexer 22 for classifying and delivering copy sheets to the respective multi-stage trays 24.

The operation of the conventional copying machine-sorter arrangement will now be described. Each of the copy sheets which has been successively discharged from the copying machine 10 is deflected by the second endless belt 23 and guided by the indexer 22 so that it is introduced into the respective trays 24, one after another, successively, from the upper tray to the lower trays.

However, in this sorter 20, each of the sorted copy sheets 25, which is deflected by the second endless belt 23, guided by the indexer 22 and then received in the tray 24, is curved downward, as shown in FIG. 1C, because the sheet is supplied with uneven stress in the direction of its thickness when it is deflected. If the respective copy sheets received in the trays 24 are curved downward, the front end of a further copy sheet which next enters any one of the trays 24 will hit upon the end 25*a* of a previously sorted copy sheet 25 since the end 25*a* projects upward beyond the height of the tray 24. Accordingly, paper jams occur in the indexer 22. Even if no paper jams occur, because the end 25*a* projects upward, it is apparent that the copy sheet capacity of the trays 24 is reduced.

SUMMARY OF THE INVENTION

An object of the present invention is to provide a sorter in which a curve-producing mechanism is provided in an indexer for making flat or upwardly curved ends of copy sheets curve downward as they are introduced into a tray, thereby increasing the number of sheets which can be received in the tray, as well as preventing the occurrence of paper jams.

The sorter of the present invention includes a plurality of trays which are vertically arranged in multiple stages at predetermined intervals, and means for conveying copy sheets into said plurality of trays and upwardly curving said copy sheets so that ends of said upwardly curved copy sheets curve downward with respect to a bottom surface of the trays. The conveying and curving means includes a conveyor which comprises an endless belt and a film sheet which convey the copy sheets to an indexer. The indexer then curves the sheets and conveys the curved sheets into the plurality of trays.

The sorter of the present invention further includes a plurality of flexible guide members which are provided at inlet portions of the multi-stage trays. These guide members cause a copy sheet which has been discharged from the indexer to advance accurately along a bottom surface of an upper tray, thus increasing the number of copy sheets which can be received in the trays without increasing an interval H between adjacent trays.

DESCRIPTION OF THE PREFERRED EMBODIMENTS

Figure 1A:
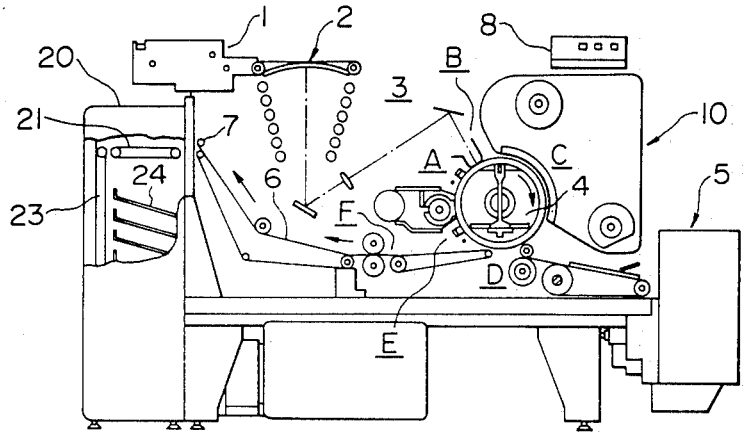
FIG. 1(A) PRIOR ART
FIG. 1A is an explanatory view showing a conventional copying machine and a sorter therefor.
Figure 1B:
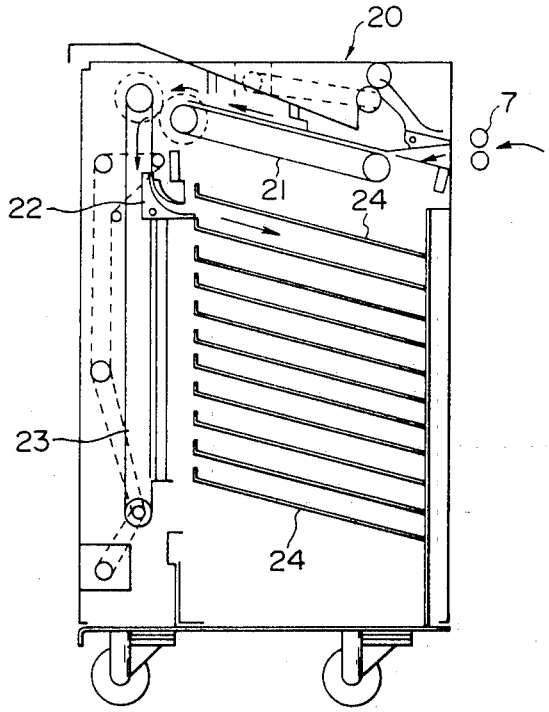
FIG. 1(B) PRIOR ART
FIG. 1B is an enlarged, partial view of the sorter of FIG. 1A.
Figure 1C:
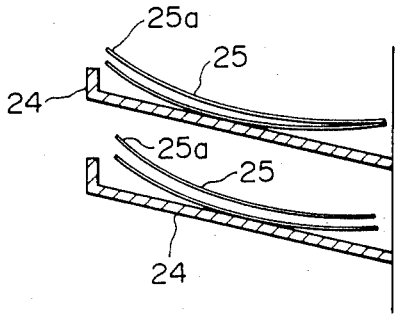
FIG. 1(C) PRIOR ART
FIG. 1C is a schematic view showing the state of copy sheets as they are received in a tray of the sorter.
Figure 2A:
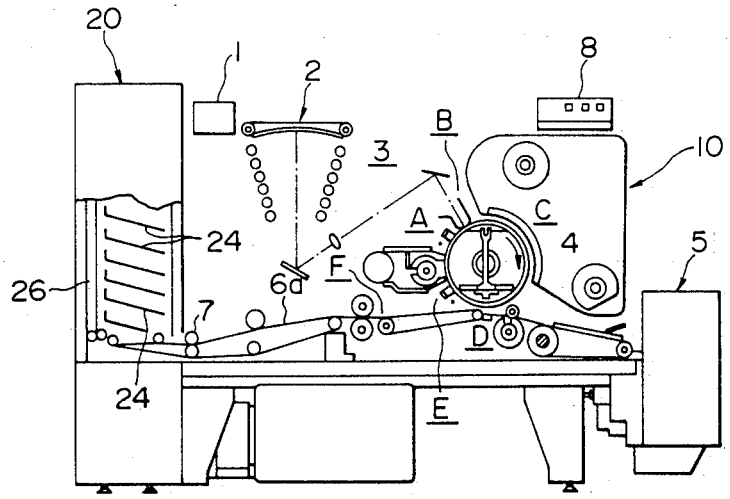
FIG. 2A is an explanatory view showing an embodiment of the present invention.
Figure 2B:
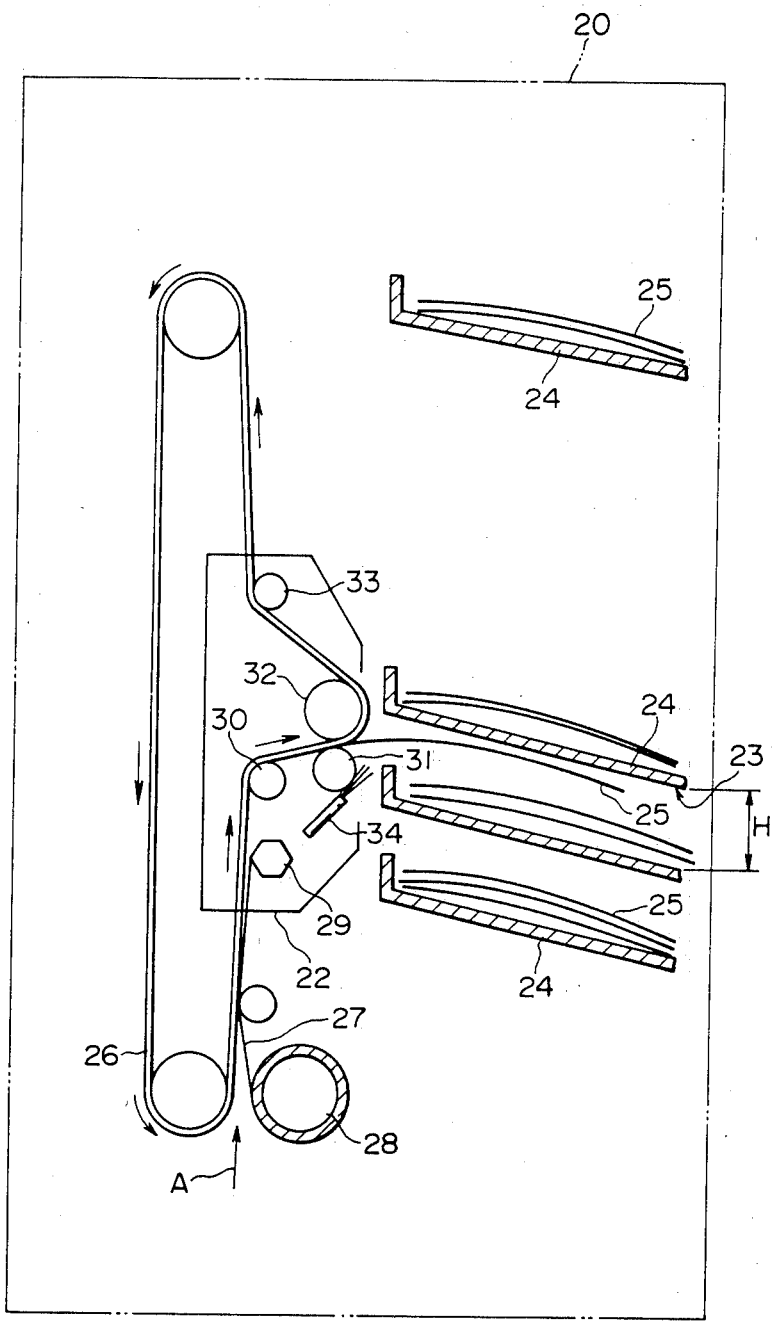
FIG. 2B is an enlarged partial view of the sorter of FIG. 2A.

FIG. 2A illustrates a copying machine-sorter arrangement of the present invention, and FIG. 2B is an enlarged, partial view of the sorter shown in FIG. 2A. Components illustrated in FIGS. 2A and 2B which are identical to components illustrated in FIGS. 1A and 1B are identified by the same reference numerals, and, therefore, an explanation of the identical components will not be repeated. In the arrangement of FIGS. 2A and 2B, a copy sheet which has passed the fixing station E is discharged through the discharge rollers 7 by a discharge belt 6*a* which is provided at the lower portion of the copying machine 10, and the copy sheet is then introduced into a lower portion of the sorter 20.

The sorter 20, according to the present invention, comprises multi-stage trays 24 which are vertically arranged at predetermined intervals; an endless belt 26 which is vertically disposed along the multi-stage trays 24; a film sheet 27 for conveying a copy sheet 25 to the trays 24 in cooperation with the endless belt 26; a film sheet fixing device 29 for fixing an end of the film sheet 27; an indexer 22*a* which is provided with rollers 30, 31, 32 and 33 for successively delivering copy sheets to the trays from a lower tray to an upper tray; a discharging brush 34 for eliminating static electricity from each copy sheet 25; and a roller 28 for winding up/off the film sheet 27.

The operation of the sorter of the present invention will now be described. A copy sheet 25 which is introduced into the sorter 20 through the lower portion of the sorter is inserted between the endless belt 26 and the film sheet 27 from the direction indicated by an arrow A. It is then conveyed upward with the upward movement of the endless belt 26 so that it is received into one of the trays 24. The copy sheet 25 is then curved upward by the endless belt 26 and the roller 30, as shown in FIG. 2B.

The upward curve of the copy sheet 25 may be formed by the rollers 31 and 32; however, the upward curve is formed mainly by the endless belt 26 and the roller 30 in the embodiment shown in FIG. 2B. When it is desired to form the upward curve principally by using the rollers 31 and 32, the diameter of the roller 31 should be made smaller than that of the roller 32 because the amount of upward curve of the copy sheet increases as the ratio between these diameters increases. The amount of upward curve of the copy sheets also increases as the diameter of the roller 30 is reduced, assuming, of course, that other variables are maintained constant. Thus, according to the embodiment of the present invention, the extent of the upward curve of the copy sheets may be controlled as desired by properly selecting the diameter of the roller 30 and the diameter ratio between the rollers 32 and 31.

In the sorter of FIGS. 2A and 2B, in order to increase the number of copy sheets which can be received in the trays by utilizing a maximum tray interval H, it is desirable to cause a copy sheet to advance along the bottom surface of an adjacent upper tray. To this end, it is necessary to stop the copy sheet discharge outlet of the indexer 22 at a vertical position which is adjacent to the forward end portion of the bottom of each tray 24. From the viewpoint of mechanical accuracy, however, it is difficult to accurately stop the indexer 22 with respect to each of the multi-stage trays 24, and, for this reason, the number of copy sheets which can be received in the trays 24 is reduced. To increase the number of copy sheets which can be received in the trays 24 to an acceptable level, the tray interval H must be increased.

Figure 3:
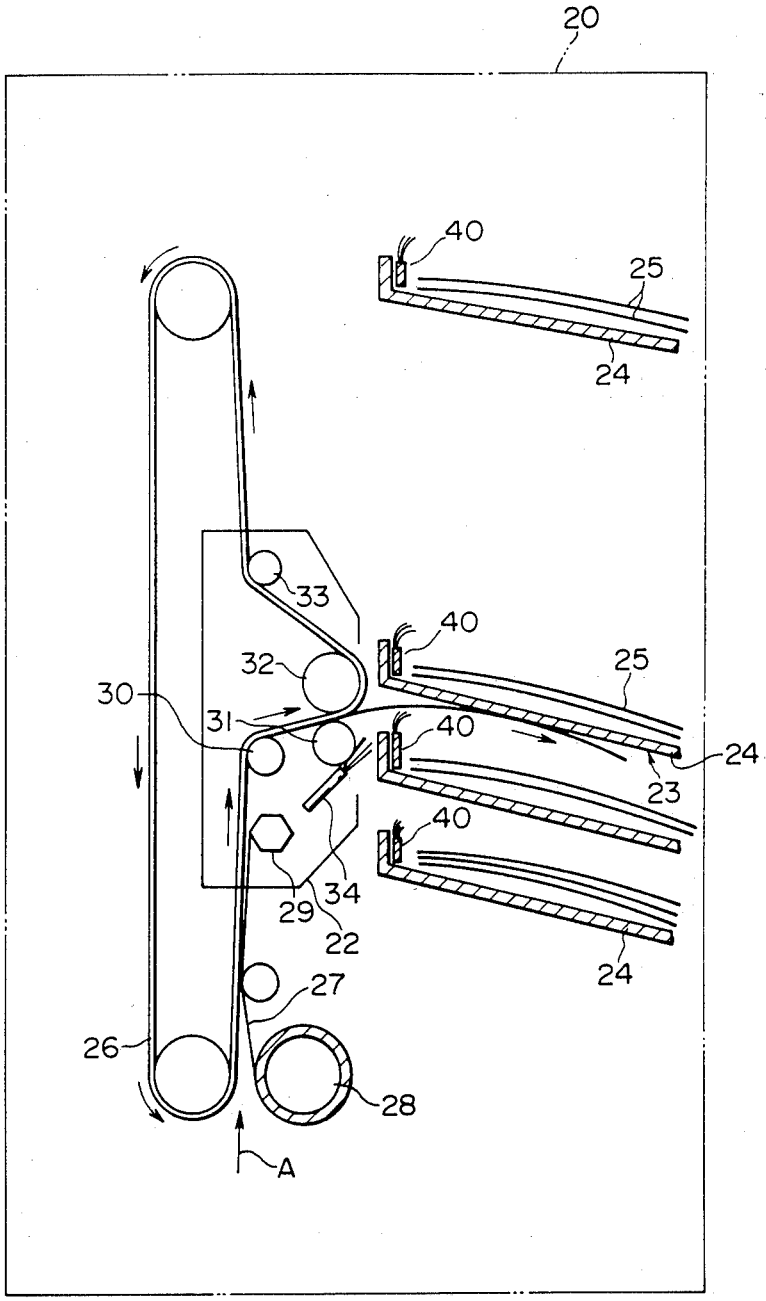
FIG. 3 is an enlarged partial view of a further embodiment of the sorter of the present invention.

According to the present invention, a flexible guide member 40, shown in FIG. 3, is provided at an inlet portion of each of the multi-stage trays 24. This flexible guide member causes a copy sheet which has been discharged from an indexer to advance accurately along a bottom surface of an upper tray to thereby increase the number of copy sheets received in the trays without increasing the interval H between adjacent trays.

The guide member 40 is made of a flexible material and is provided at the forward end of each of the trays 24 so that a copy sheet which has been discharged from the indexer 22 is positively pressed against the bottom surface of the upper tray 24. The flexible guide member 40 may be any type, such as a brush-like guide member, a film-like guide member, etc., as long as it is flexible and able to restrict the advancing direction of the copy sheet. The flexible guide member 40 may be placed at any position, as long as it is disposed at a forward end portion of the tray 24 and in the path of the copy sheets at the inlet of the tray.

The operation of the sorter described above will now be described. A copy sheet 25 is discharged from the copy machine 10 and is introduced into the sorter 20 through the lower portion of the sorter. The sheet is then inserted between the endless belt 26 and the film sheet 27 from the direction indicated by an arrow A and conveyed upward with the upward movement of the endless belt 26 so that it is received into one of the trays 24. At this time, the copy sheet 25 is guided to the inlet portion of the tray 24 while it is curved upward by the endless belt 26 and the roller 30. It is then introduced into the tray 24 while being pressed against the bottom surface 23 of the upper tray by the flexible guide member 40.

As described above, in the sorter according to the present invention, a flexible guide member is provided at the inlet portion of each of the multi-stage trays to cause a copy sheet which has been discharged from an indexer to advance along the bottom surface of the upper tray. Thus, the number of copy sheets which can be received in the multi-stage trays can be increased without increasing the interval between adjacent multi-stage trays.

We claim:

1. A sorter for sorting copy sheets made from an original by a copying machine, comprising:

a plurality of trays vertically arranged in multiple stages at predetermined intervals;

a vertically movable indexer for delivering copy sheets to predetermined trays, said indexer including means for upwardly curving said copy sheets as said copy sheets are delivered into said predetermined trays so that ends of said upwardly curved copy sheets curve downwardly with respect to a bottom surface of said trays;

a conveyor for conveying said copy sheets to said indexer; and a flexible guide member provided at an inlet portion of a first tray for guiding a copy sheet discharged from said indexer into said first tray along a bottom surface of a second tray located above said first tray, said flexible guide member being capable of yielding under force of contact with one of said copy sheets.

2. The sorter as claimed in claim 1, wherein said flexible guide member comprises a brush-like guide member.

3. The sorter as claimed in claim 1, wherein said flexible guide member comprises a film-like guide member.

4. The sorter as claimed in claim 1, wherein said curving means of said indexer comprises at least one roller for changing a direction of conveyance of said copy sheets conveyed by said conveyor.

5. The sorter as claimed in claim 4, wherein said curving means further comprises two additional opposed rollers having different diameters which are located downstream of said at least one roller, said conveyed copy sheets being transported between said two additional opposed rollers.

6. The sorter as claimed in claim 5, wherein said conveyor comprises an endless belt and a film sheet, said copy sheets being conveyed between said endless belt and said film sheet to said indexer.

7. The sorter as claimed in claim 6, wherein said curved sheet ends correspond to front and rear ends of said copy sheet relative to a conveying direction thereof.

* * * * *